US008381369B2

(12) United States Patent
Wang

(10) Patent No.: US 8,381,369 B2
(45) Date of Patent: Feb. 26, 2013

(54) ROLLER ZIPPER SLIDE

(76) Inventor: Lien-Chou Wang, New Taipei (TW)

( * ) Notice: Subject to any disclaimer, the term of this patent is extended or adjusted under 35 U.S.C. 154(b) by 224 days.

(21) Appl. No.: 13/014,038

(22) Filed: Jan. 26, 2011

(65) Prior Publication Data

US 2012/0186049 A1 Jul. 26, 2012

(51) Int. Cl.
*A44B 19/26* (2006.01)

(52) U.S. Cl. ..... 24/415

(58) Field of Classification Search ..... 24/415, 24/417, 430, 429; 383/64
See application file for complete search history.

(56) References Cited

U.S. PATENT DOCUMENTS 1,703,712 A * 2/1929 Aud ..... 383/64
3,189,038 A * 6/1965 Von Pechmann ..... 137/315.07
3,919,745 A * 11/1975 Dupon ..... 24/424
5,081,747 A * 1/1992 Takizawa et al. ..... 24/415
6,026,546 A * 2/2000 Lund et al. ..... 24/431
7,219,402 B2 * 5/2007 Yamazaki ..... 24/429
7,416,339 B2 * 8/2008 Plourde et al. ..... 383/64
7,464,445 B1 * 12/2008 Lin ..... 24/415
7,650,674 B2 * 1/2010 Miyazaki et al. ..... 24/424
2012/0117709 A1 * 5/2012 Damon et al. ..... 2/85
2012/0117766 A1 * 5/2012 Damon et al. ..... 24/415

* cited by examiner

*Primary Examiner* — Victor Batson
*Assistant Examiner* — Rowland D Do
(74) *Attorney, Agent, or Firm* — Jackson IPG PLLC

(57) ABSTRACT

A roller zipper slide includes a slide body having a longitudinal slot on a top slide body block in communication with an internal chamber thereof and two coupling grooves located at two opposite lateral sides of the longitudinal slot. The roller zipper slide further includes a roller pivotally having two pivot pins respectively pivotally coupled to the coupling grooves and a bottom side thereof projecting into the internal chamber of the slide body right above the engaging position between the left and right series of teen of the zip fastener, thereby improving sliding mobility, reducing zipper teeth wear and prolonging zipper slide lifespan.

7 Claims, 12 Drawing Sheets

ROLLER ZIPPER SLIDE

BACKGROUND OF THE INVENTION

1. Field of the Invention

The present invention relates to zippers and more particularly, to a roller zipper slide for zip fastener, which employs a rolling contact technique to substitute for conventional surface friction designs, improving sliding mobility, reducing zipper teeth wear and prolonging zipper slide lifespan.

2. Description of the Related Art

The basic functional design of a zipper slide derives from rotating engagement between gears. The left series of teeth and right series of teeth of a zip fastener are regarded as two equal length flexible tooth bar. A zipper slide is movable by a pull tab to interlock or separate left and right series of teeth. If the protruding upper faces of the left series of teeth are stopped against the protruding upper faces of the right series of teeth during movement of the zipper slide to interlock the left and right series of teeth, much friction resistance will be produced, interfering sliding mobility. Further, if the protruding upper faces of the left and right series of teeth are not kept in horizontal during interlocking, the teeth may be not interlocked positively. To enhance sliding mobility, the internal dimension of a zipper slide may be corrected. However, because different zip fastener manufacturers provide different specifications of zip fastener component parts, all commercial zip fastener components are not interchangeable. There are tolerance control on zipper slide specifications and interlocking teeth. However, when the zipper slide of a zip fastener used in a bag or tent is moved to the head end or tail end, biasing of the pull tab in a particular angle may cause the zipper slide to rub against the interlocking teeth or zipper tapes, causing a zipper tooth or zipper tape damage and shortening the lifespan of the zip fastener,

SUMMARY OF THE INVENTION

The present invention has been accomplished under the circumstances in view. It is the main object of the present invention to provide a roller zipper slide for zip fastener, which improves sliding mobility, reduces zipper teeth wear and prolongs zipper slide lifespan.

To achieve this and other objects of the present invention, a roller zipper slide includes a slide body having a longitudinal slot on a top slide body block in communication with an internal chamber thereof and two coupling grooves located at two opposite lateral sides of the longitudinal slot, a roller pivotally having two pivot pins respectively pivotally coupled to the coupling grooves and a bottom side thereof projecting into the internal chamber of the slide body right above the engaging position between the left and right series of teen of the zip fastener, thereby improving sliding mobility, reducing zipper teeth wear and prolonging zipper slide lifespan.

Thus, when the left series of teeth and right series of teeth of the zip fastener that are separated by a center block of the slide body enter the inside of the roller zipper slide, the bottom side of the roller that projects vertically downwardly into the internal chamber of the roller zipper slide right above the engaging position between the left and right series of teen of the zip fastener is kept in contact with the interlocking teeth of the zip fastener, preventing teeth damage due to biasing of the pull tab in a particular angle.

Further, during sliding movement of the zipper slide to close or open the left and right series of teen of the zip fastener, the roller is rotated relative to and kept in contact with the topmost edges of the protruding upper faces of the left and right series of teeth, minimizing friction resistance, enhancing sliding mobility and prolonging zip fastener's lifespan.

Further, when the roller is moved to the head end or tail end of the zip fastener, the bottom side of the roller is kept in contact with the teeth of the zip fastener, minimizing surface friction and heat generation and preventing teeth damage due to biasing of the pull tab in a particular angle.

DETAILED DESCRIPTION OF THE INVENTION

Figure 1:
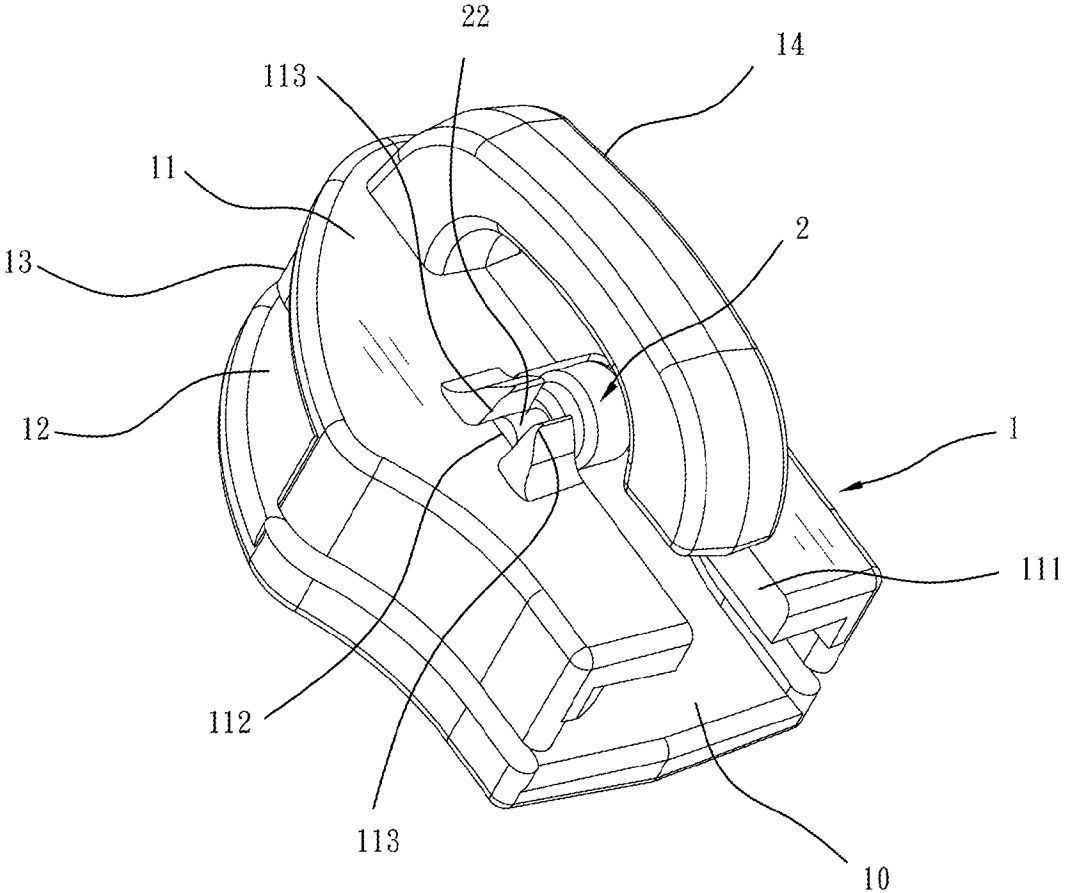
FIG. 1 is an elevational view of a roller zipper slide in accordance with a first embodiment of the present invention.
Figure 2:
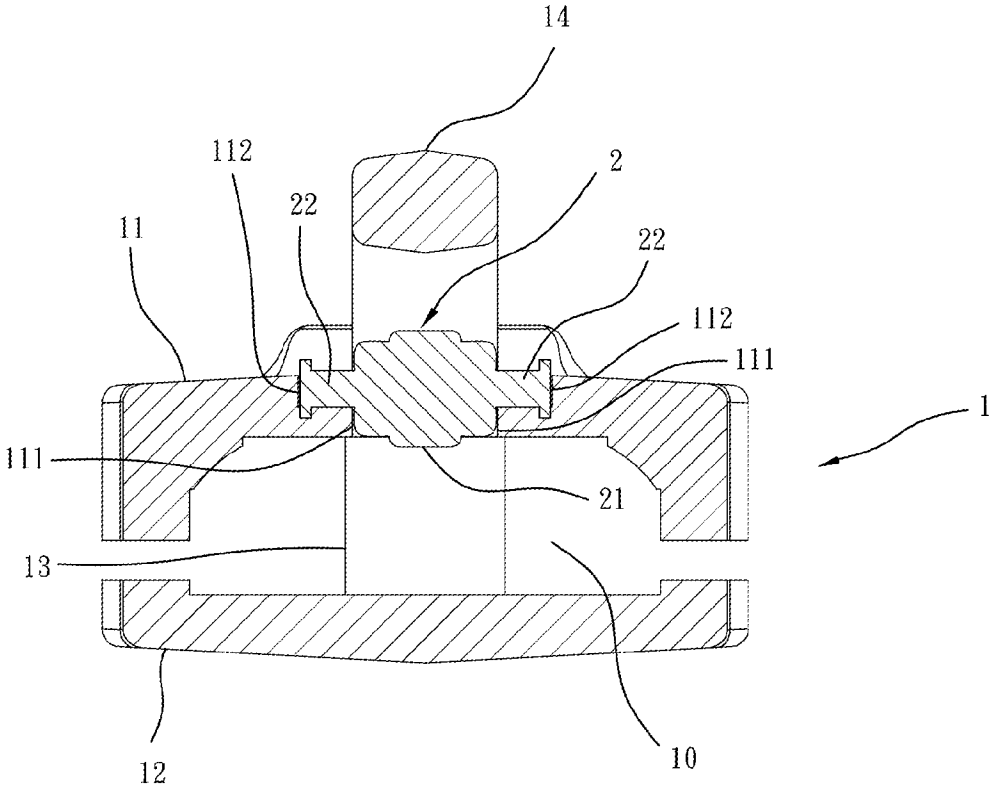
FIG. 2 is a sectional view of the roller zipper slide in accordance with the first embodiment of the present invention.
Figure 3:
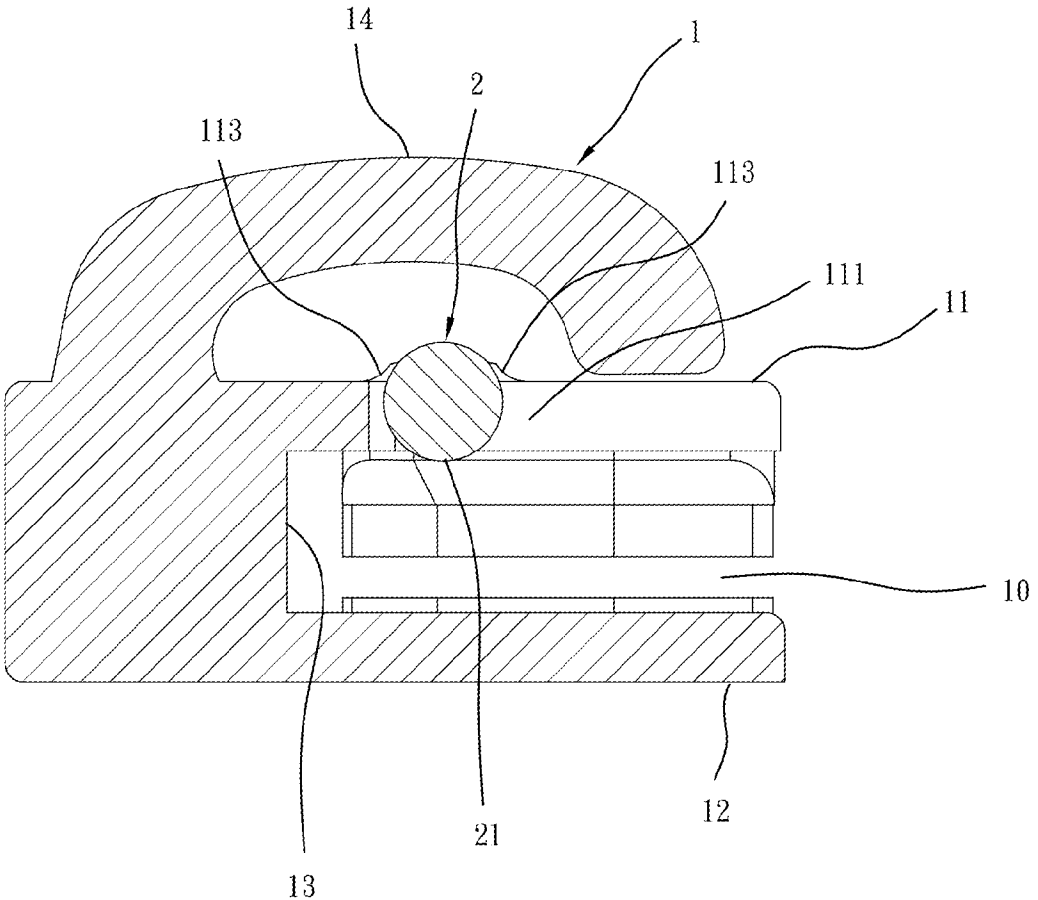
FIG. 3 is another sectional view of the roller zipper slide in accordance with the first embodiment of the present invention.

Referring to FIGS. 1~3, a roller zipper slide 1 in accordance with a first embodiment of the present invention employs a rolling contact technique to substitute for conventional surface friction designs, improving sliding mobility, reducing zipper teeth wear and prolonging zipper slide lifespan. As illustrated, the roller zipper slide 1 comprises a top slide body block 11, a bottom slide body block 12, a center block 13 connected between the top slide body block 11 and the bottom slide body block 12, an internal chamber 10 defined in between the top slide body block 11 and the bottom slide body block 12, and a crown 14 located on the top side of the top slide body block 11 for holding a pull tab (not shown).

The main features of the roller zipper slide 1 are outlined hereinafter.

The top slide body block 11 has a longitudinal slot 111 cut through the top and bottom sides thereof on the middle and two coupling grooves 112 located at two opposite lateral sides of the longitudinal slot 111. The coupling grooves 112 can be made having a H-shaped, conical or rounded profile symmetrically disposed at two opposite lateral sides of the longitudinal slot 111, and configured to prevent the longitudinal slot 111 from breaking. Further, the longitudinal slot 111 is kept in communication with the internal chamber 10. Further, a roller 2 is pivotally mounted in the internal chamber 10 and coupled between the coupling grooves 112. The roller 2 has its bottom side 21 projects into the internal chamber 10 of the roller zipper slide 1 (see FIGS. 2 and 3) right above the engaging position between the left and right series of teen of the zip fastener (not shown). When closing or opening the zip fastener, the bottom side 21 of the roller 2 is kept in contact with the interlocking teeth of the zip fastener, keeping the protruding upper faces of the left and right series of teeth on the same elevation, assuring positive engagement between the protruding upper faces of the left a series of teeth and the protruding upper faces of the right series of teeth. During sliding movement of the zipper slide to close or open the left and right series of teen of the zip fastener, the roller 2 is rotated relative to and kept in contact with the topmost edges of the protruding upper faces of the left and right series of teeth, minimizing friction resistance, enhancing sliding mobility and prolonging zip fastener's lifespan. Even when the roller 2 is moved to the head end or tail end of the zip fastener, the bottom side 21 of the roller 2 is kept in contact with the teeth of the zip fastener, preventing teeth damage due to biasing of the pull tab in a particular angle.

Further, the roller 2 has two pivot pins 22 respectively extended from the two opposite lateral sides thereof and respectively pivotally coupled to the coupling grooves 112 of the top slide body block 11.

Further, stop members 113 are respectively protruded from the top side of the top slide body block 11 at two opposite lateral sides of each of the coupling grooves 112 to keep the roller 2 in place.

Figure 4:
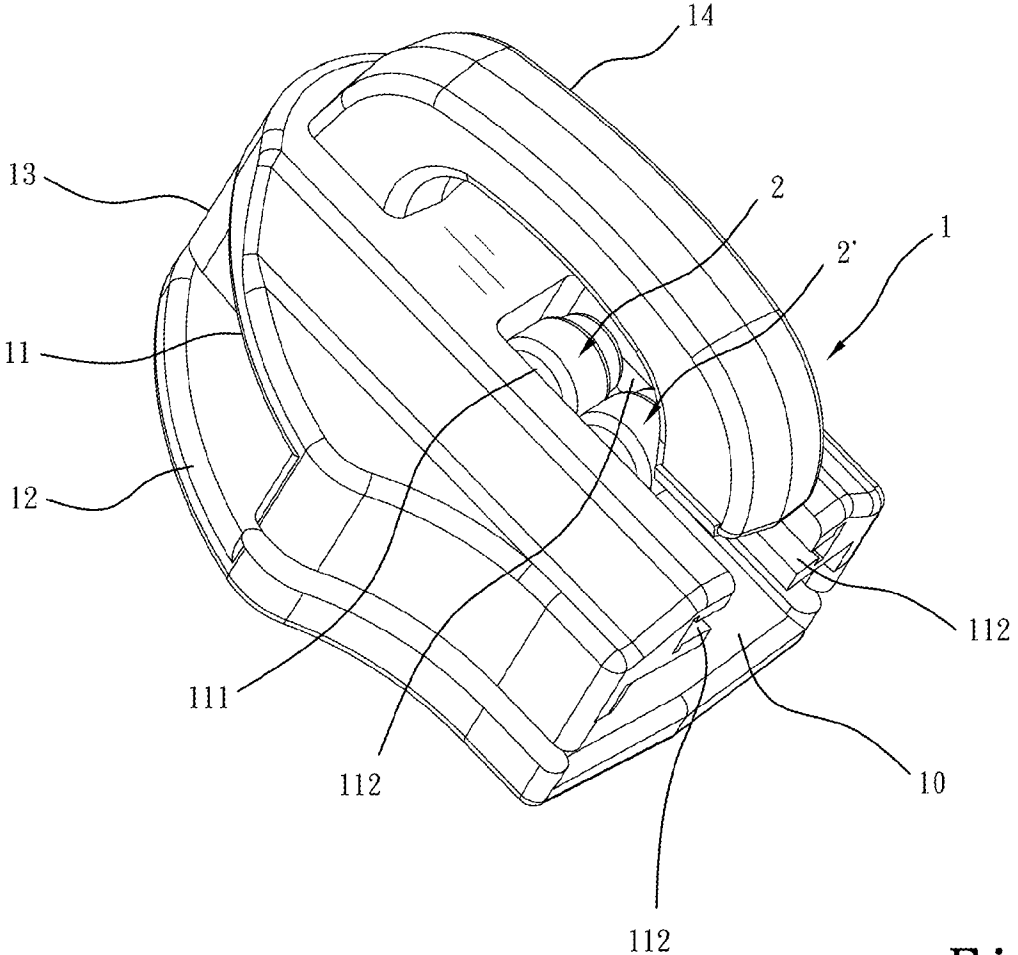
FIG. 4 is an elevational view of a roller zipper slide in accordance with a second embodiment of the present invention.
Figure 5:
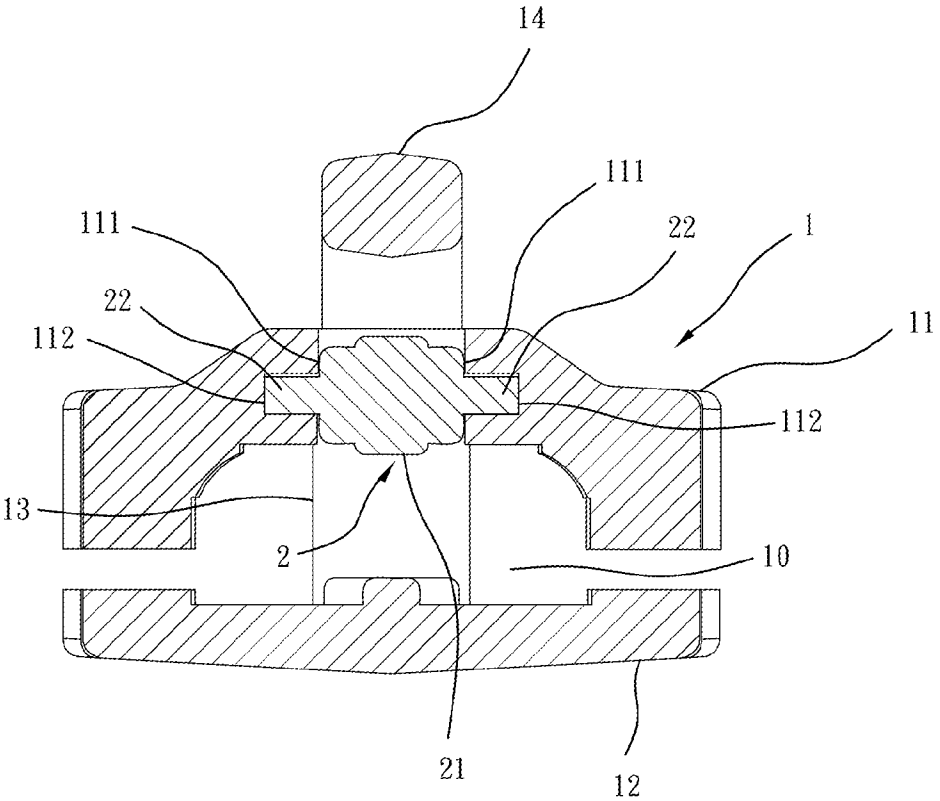
FIG. 5 is a sectional view of the roller zipper slide in accordance with the second embodiment of the present invention.

FIGS. 4 and 5 illustrate a roller zipper slide 1 in accordance with a second embodiment of the present invention. The top slide body block 11 of the roller zipper slide 1 of this second embodiment has a longitudinal slot 111 cut through the top and bottom sides thereof on the middle and two coupling grooves 112 located at two opposite lateral sides of the longitudinal slot 111. The coupling grooves 112 can be made having a U-shaped, H-shaped, dovetailed, conical or rounded profile symmetrically disposed at two opposite lateral sides of the longitudinal slot 111, and configured to prevent the longitudinal slot 111 from breaking. Further, the longitudinal slot 111 is kept in communication with the internal chamber 10 of the roller zipper slide 1 (see FIG. 5). Further, the length of the coupling grooves 112 in longitudinal direction is relatively longer than the aforesaid first embodiment for accommodating two rollers 2;2'. The two rollers 2;2' each have two pivot pins 22;22' respectively extended from the two opposite lateral sides thereof and respectively pivotally coupled to the coupling grooves 112 of the top slide body block 11 such that the bottom sides 21;21' of the rollers 2;2' project into the internal chamber 10 of the roller zipper slide 1 right above the engaging position between the left and right series of teen of the zip fastener, and the bottom side 21 of one roller 2 is kept in contact with the interlocking teeth of the zip fastener, preventing teeth damage due to biasing of the pull tab in a particular angle. Further, stop members (not shown) are respectively protruded from the top side of the top slide body block 11 at two opposite lateral sides of each of the coupling grooves 112 to keep the rollers 2;2' in place. The technical contents of this second embodiment are same as the aforesaid first embodiments, and therefore no further detailed description in this regard is necessary.

Figure 6:
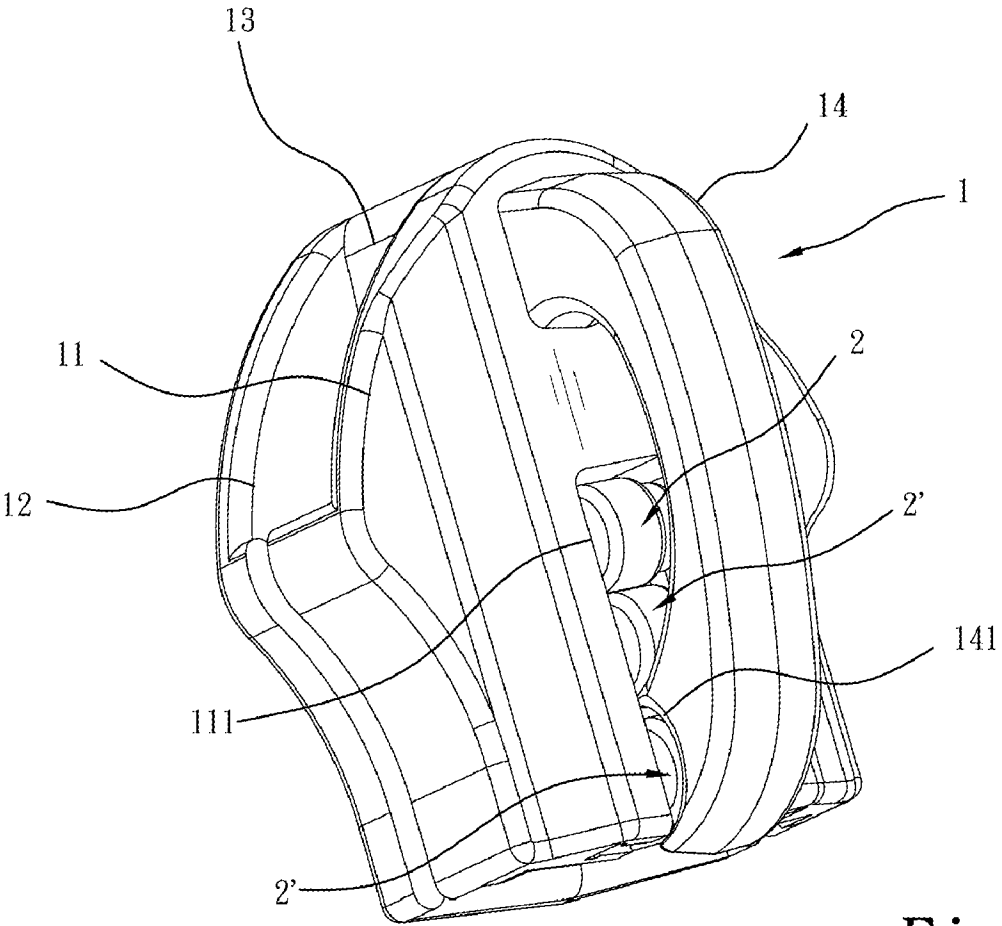
FIG. 6 is an elevational view of a roller zipper slide in accordance with a third embodiment of the present invention.
Figure 7:
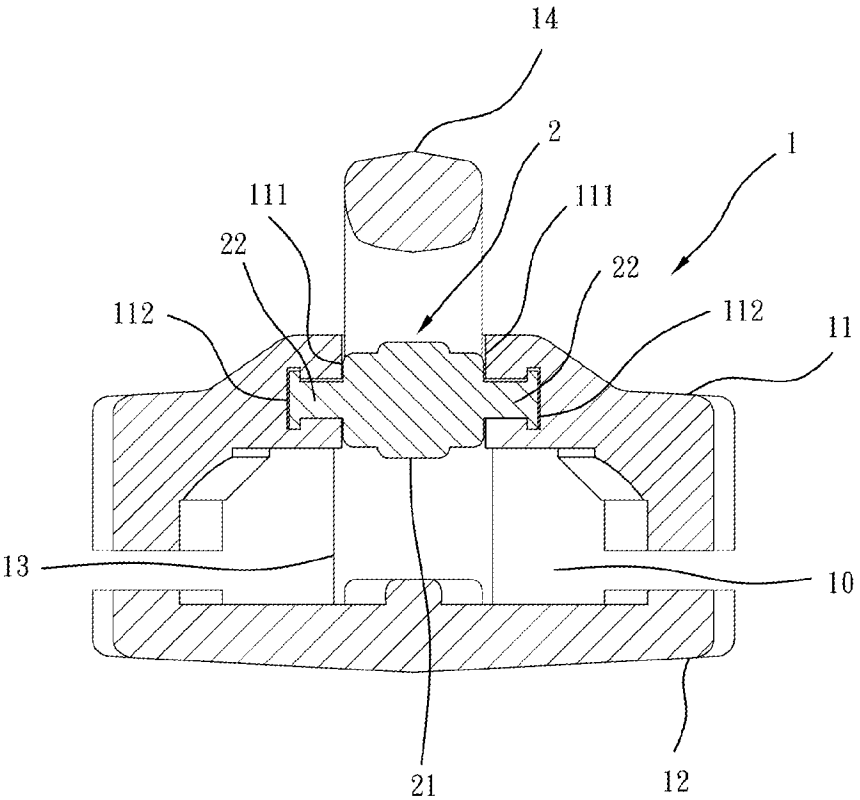
FIG. 7 is a sectional view of the roller zipper slide in accordance with the third embodiment of the present invention.
Figure 8:
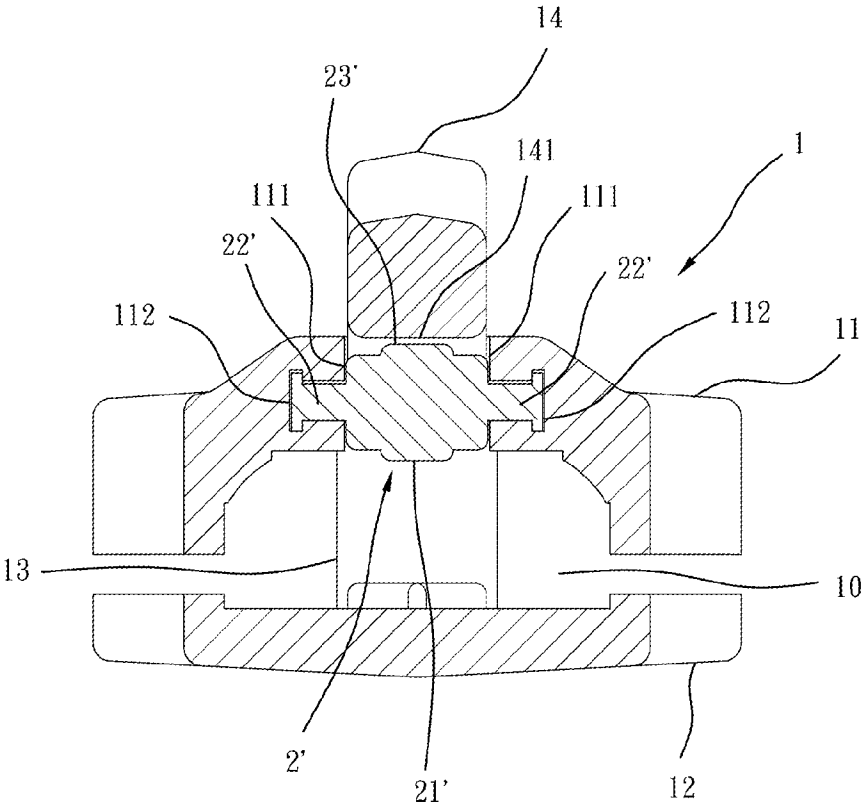
FIG. 8 is another sectional view of the roller zipper slide in accordance with the third embodiment of the present invention.

FIGS. 6~8 illustrate a roller zipper slide 1 in accordance with a third embodiment of the present invention. The top slide body block 11 of the roller zipper slide 1 of this third embodiment has a longitudinal slot 111 cut through the top and bottom sides thereof on the middle and two coupling grooves 112 located at two opposite lateral sides of the of the longitudinal slot 111. The coupling grooves 112 can be made having a U-shaped, H-shaped, dovetailed, conical or rounded profile symmetrically disposed at two opposite lateral sides of the longitudinal slot 111, and configured to prevent the longitudinal slot 111 from breaking. Further, the longitudinal slot 111 is kept in communication with the internal chamber 10 of the roller zipper slide 1. Further, the length of the coupling grooves 112 in longitudinal direction is relatively longer than the aforesaid first and second embodiments for accommodating multiple rollers 2;2'. The rollers 2;2' each have two pivot pins 22;22' respectively extended from the two opposite lateral sides thereof and respectively pivotally coupled to the coupling grooves 112 of the top slide body block 11 such that the bottom sides 21;21' of the rollers 2;2' project into the internal chamber 10 of the roller zipper slide 1 (see FIGS. 7 and 8) right above the engaging position between the left and right series of teen of the zip fastener, and the bottom side 21 of one roller 2 is kept in contact with the interlocking teeth of the zip fastener, preventing teeth damage due to biasing of the pull tab in a particular angle. Further, the middle top side 23 of the outer roller 2 is rotatably constrained to an arched groove 141 on the bottom side of the crown 14 (see FIG. 8), and therefore the rollers 2;2' are prohibited from escaping out of the coupling grooves 112 of the top slide body block 11. Other features of this third embodiment are same as the aforesaid first and second embodiments, and therefore no further detailed description in this regard is necessary.

Figure 9:
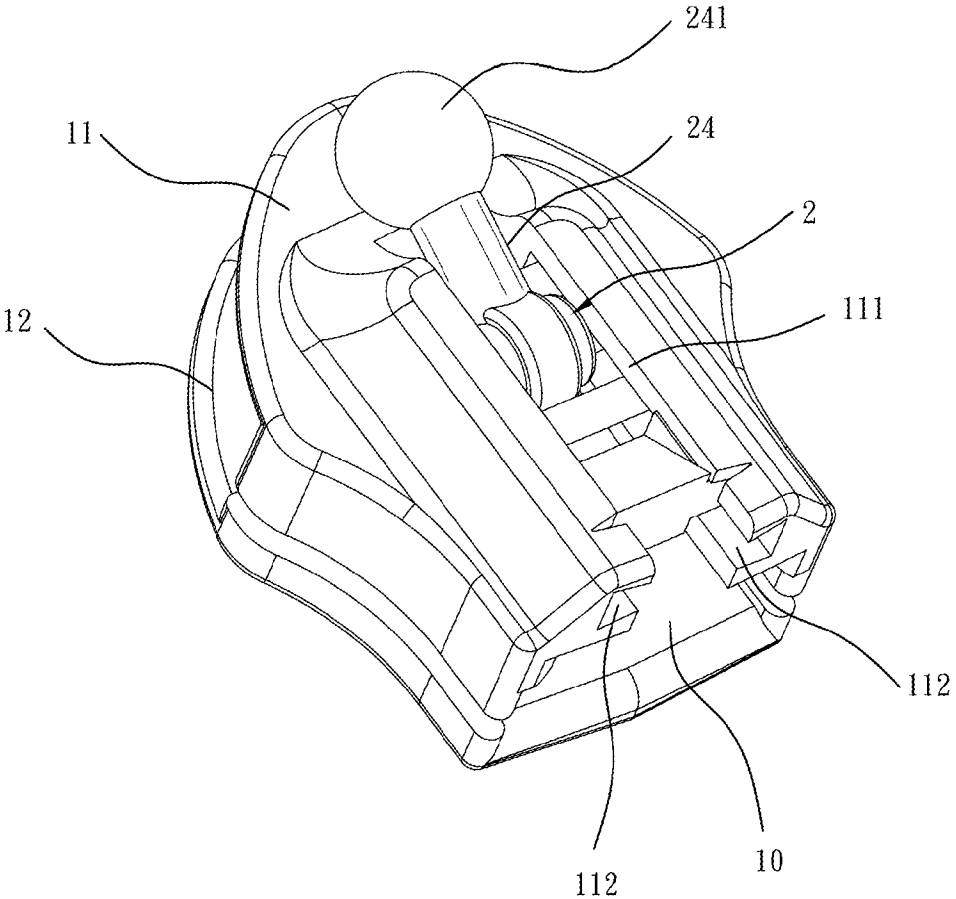
FIG. 9 is an elevational view of a roller zipper slide in accordance with a fourth embodiment of the present invention.
Figure 10:
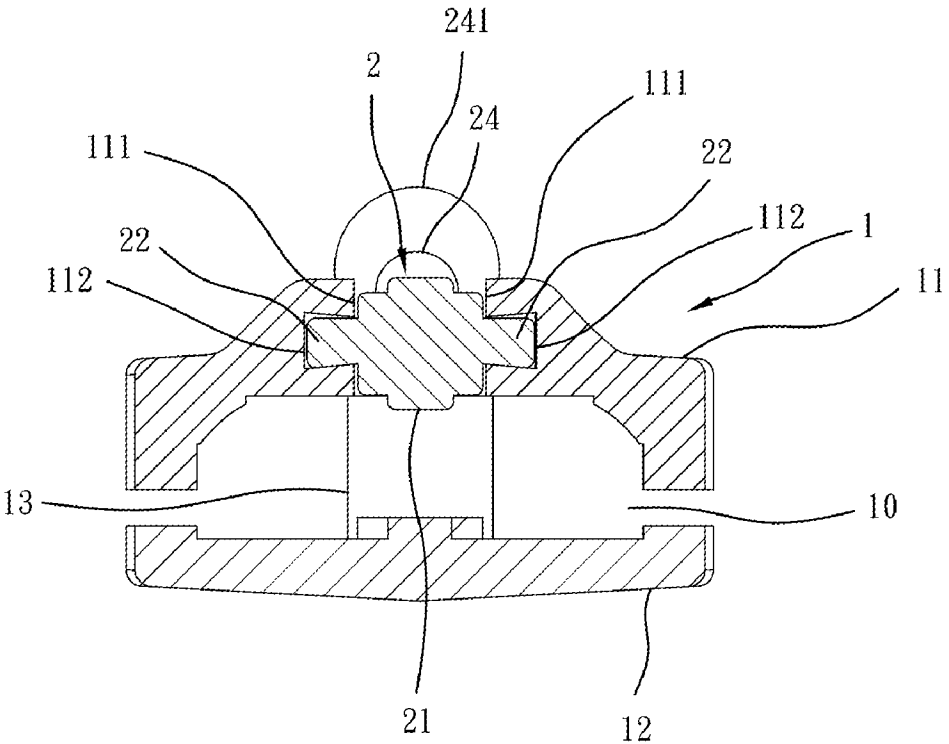
FIG. 10 is a sectional view of the roller zipper slide in accordance with the fourth embodiment of the present invention.
Figure 11:
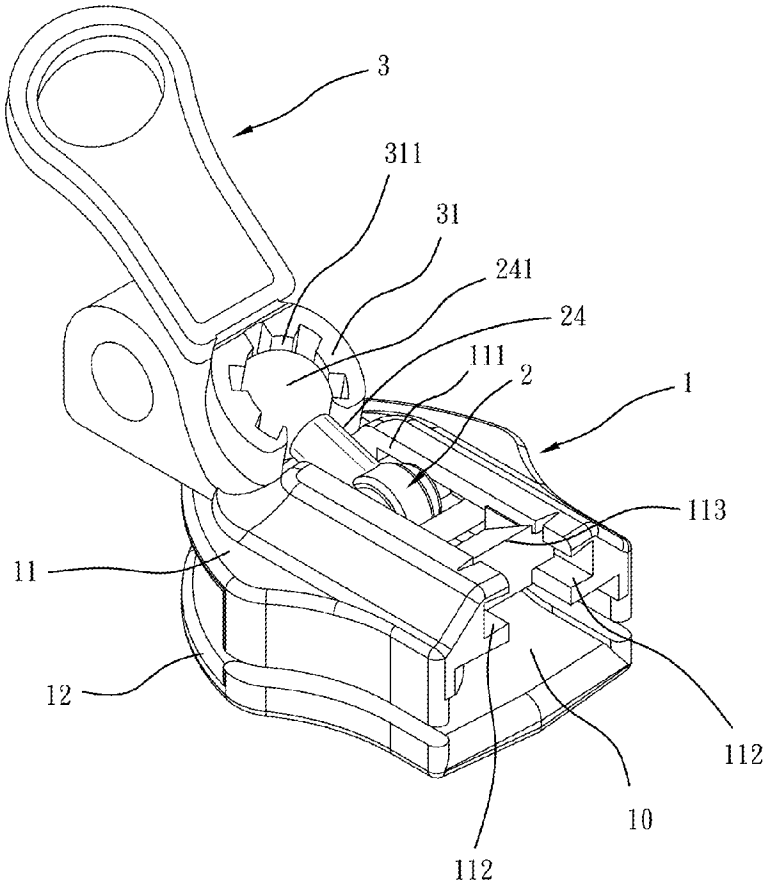
FIG. 11 is an elevational view of the fourth embodiment of the present invention, illustrating a pull tab coupled to the roller zipper slide.

FIGS. 9~11 illustrate a roller zipper slide 1 in accordance with a fourth embodiment of the present invention. The top slide body block 11 of the roller zipper slide 1 of this fourth embodiment has a longitudinal slot 111 cut through the top and bottom sides thereof on the middle and two coupling grooves 112 located at two opposite lateral sides of the of the longitudinal slot 111. The coupling grooves 112 can be made having a U-shaped, dovetailed or raised profile symmetrically disposed at two opposite lateral sides of the longitudinal slot 111, and configured to prevent the longitudinal slot 111 from breaking. Further, the longitudinal slot 111 is kept in communication with the internal chamber 10 of the roller zipper slide 1. Further, a roller 2 is pivotally mounted in the internal chamber 10 and coupled between the coupling grooves 112. The roller 2 has two pivot pins 22 respectively extended from the two opposite lateral sides thereof and respectively pivotally coupled to the coupling grooves 112 of the top slide body block 11 such that the bottom sides 21 of the rollers 2 project into the internal chamber 10 of the roller zipper slide 1 right above the engaging position between the left and right series of teen of the zip fastener, and the bottom side 21 of one roller 2 is kept in contact with the interlocking teeth of the zip fastener, preventing teeth damage due to biasing of the pull tab in a particular angle. Further, this fourth embodiment eliminates the aforesaid crown 14. Further, a connector 24 extends from the roller 2 at the top, and terminates in a ball head 241 for the connection of a pull tab 3. The pull tab 3 has an arched coupling arm 31 located on one end thereof and pivotally coupled to the ball head 241 of the connector 24, and a plurality of arched teeth 311 protruded from an inside wall of the arched coupling arm 31 and kept in contact with the periphery of the ball head 241. Further, stop members 113 are respectively protruded from the top side of the top slide body block 11 to keep the roller 2 in place. Other features of this fourth embodiment are same as the aforesaid first embodiment, and therefore no further detailed description in this regard is necessary.

Figure 12:
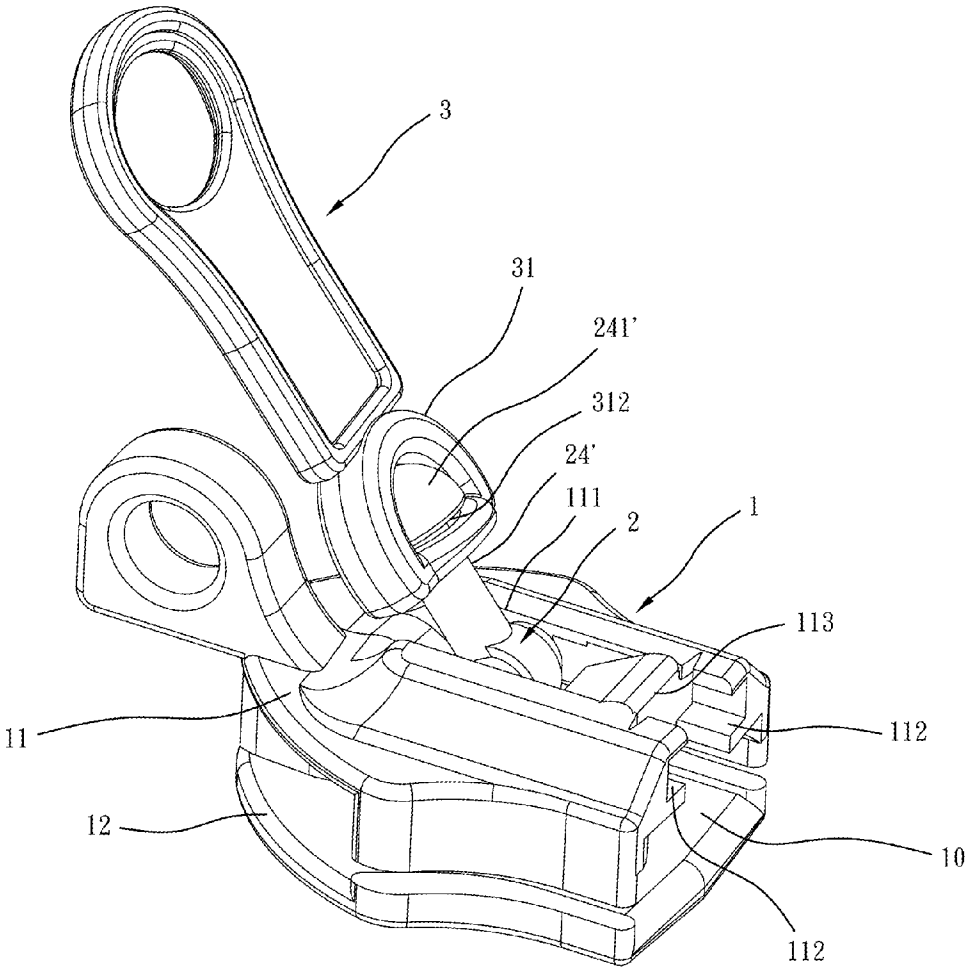
FIG. 12 is an elevational view of a roller zipper slide in accordance with a fifth embodiment of the present invention.

FIG. 12 illustrates a roller zipper slide 1 in accordance with a fifth embodiment of the present invention. The top slide body block 11 of the roller zipper slide 1 of this fifth embodiment has a longitudinal slot 111 cut through the top and bottom sides thereof on the middle and two coupling grooves 112 located at two opposite lateral sides of the of the longitudinal slot 111. The coupling grooves 112 can be made having a U-shaped, dovetailed or raised profile symmetrically disposed at two opposite lateral sides of the longitudinal slot 111, and configured to prevent the longitudinal slot 111 from breaking. Further, the longitudinal slot 111 is kept in communication with the internal chamber 10 of the roller zipper slide 1. Further, a roller 2 is pivotally mounted in the internal chamber 10 and coupled between the coupling grooves 112. The roller 2 has two pivot pins (not shown) respectively extended from the two opposite lateral sides thereof and respectively pivotally coupled to the coupling grooves 112 of the top slide body block 11 such that the bottom sides 21 of the rollers 2 project into the internal chamber 10 of the roller zipper slide 1 right above the engaging position between the left and right series of teen of the zip fastener, and the bottom side 21 of one roller 2 is kept in contact with the interlocking teeth of the zip fastener, preventing teeth damage due to biasing of the pull tab in a particular angle. Further, this fourth embodiment eliminates the aforesaid crown 14. Further, a connector 24' extends from the roller 2 at the top, and terminates in a semispherical head 241' for the connection of a pull tab 3. The pull tab 3 has a swivel member 31 located on one end thereof and pivotally coupled to the semispherical head 241' of the connector 24'. The swivel member 31 has a pivot hole 312 for the passing of the body of the connector 24' to prohibit disconnection of the semispherical head 241' from the swivel member 31. Further, stop members 113 are respectively protruded from the top side of the top slide body block 11 to keep the roller 2 in place. Other features of this fourth embodiment are same as the aforesaid first embodiment, and therefore no further detailed description in this regard is necessary.

In conclusion, the invention provides a roller zipper slide for zip fastener, which has advantages as follows:

1. When the left series of teeth and right series of teeth of the zip fastener that are separated by the center block 13 enter the inside of the roller zipper slide 1, the bottom side 21 of the roller 2 that projects vertically downwardly into the internal chamber 10 of the roller zipper slide 1 right above the engaging position between the left and right series of teen of the zip fastener is kept in contact with the interlocking teeth of the zip fastener, preventing teeth damage due to biasing of the pull tab in a particular angle.

2. During sliding movement of the zipper slide to close or open the left and right series of teen of the zip fastener, the roller 2 is rotated relative to and kept in contact with the topmost edges of the protruding upper faces of the left and right series of teeth, minimizing friction resistance, enhancing sliding mobility and prolonging the zip fastener's lifespan.

3. When the roller 2 is moved to the head end or tail end of the zip fastener, the bottom side 21 of the roller 2 is kept in contact with the teeth of the zip fastener, minimizing surface friction and heat generation and preventing teeth damage due to biasing of the pull tab in a particular angle.

While only few embodiment of the present invention have been shown and described, it will be understood that various modifications and changes could be made thereunto without departing from the spirit and scope of the invention disclosed.

What is claimed is:

1. A roller zipper slide for zip fastener, comprising:

a top slide body block;

a bottom slide body block;

a center block connected between said top slide body block and said bottom slide body block;

an internal chamber defined in between said top slide body block and said bottom slide body block; and a crown located on a top side of said top slide body block for holding a pull tab, wherein said top slide body block has a longitudinal slot cut through top and bottom sides thereof on the middle and kept in communication with said internal chamber and two coupling grooves located at two opposite lateral sides of said longitudinal slot; at least one roller is pivotally mounted in said internal chamber and coupled between said coupling grooves, said roller having two pivot pins respectively extended from two opposite lateral sides thereof and respectively pivotally coupled to said coupling grooves and a bottom side thereof projecting into said internal chamber of said roller zipper slide right above an engaging position between the left and right series of teeth of the zip fastener, and wherein said crown has an arched groove located on a bottom side thereof; said roller has a middle top side thereof rotatably coupled to said arched groove of said crown.

2. The roller zipper slide as claimed in claim 1, wherein multiple rollers are pivotally mounted in said internal chamber and coupled between said coupling grooves in a parallel manner, each said roller having two pivot pins respectively extended from two opposite lateral sides thereof and respectively pivotally coupled to said coupling grooves and a bottom side thereof projecting into said internal chamber of said roller zipper slide right above the engaging position between the left and right series of teeth of the zip fastener.

3. The roller zipper slide as claimed in claim 1, wherein said coupling grooves are configured to provide one of U-shaped, H-shaped, conical and rounded profiles.

4. The roller zipper slide as claimed in claim 1, wherein multiple rollers are pivotally mounted in said internal chamber and coupled between said coupling grooves in a parallel manner, each said roller having two pivot pins respectively extended from two opposite lateral sides thereof and respectively pivotally coupled to said coupling grooves, one said roller having a bottom side thereof projecting into said internal chamber of said roller zipper slide right above the engaging position between the left and right series of teeth of the zip fastener.

5. The roller zipper slide as claimed in claim 4, wherein said top block has a plurality of stop members protruded from a top wall thereof and respectively disposed at two opposite lateral sides of each of said coupling grooves to keep said pivot pins of said rollers in said coupling grooves.

6. The roller zipper slide as claimed in claim 4, wherein said crown has an arched groove located on a bottom side thereof; one said roller has a middle top side thereof rotatably coupled to said arched groove of said crown.

7. The roller zipper slide as claimed in claim 1, wherein said top block has a plurality of stop members protruded from a top wall thereof and respectively disposed at two opposite lateral sides of each of said coupling grooves to keep said pivot pins of said rollers in said coupling grooves.

* * * * *